US011280524B2

(12) United States Patent
Slothower et al.

(10) Patent No.: US 11,280,524 B2
(45) Date of Patent: Mar. 22, 2022

(54) SYSTEMS FOR A CHILLER ELECTRICAL ENCLOSURE

(71) Applicant: Johnson Controls Technology Company, Auburn Hills, MI (US)

(72) Inventors: Scott Victor Slothower, Dillsburg, PA (US); Ajit Wasant Kane, York, PA (US); Seth Kevin Gladfelter, Red Lion, PA (US); Jeb William Schreiber, Stewartstown, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/755,061

(22) PCT Filed: Oct. 10, 2018

(86) PCT No.: PCT/US2018/055251
§ 371 (c)(1),
(2) Date: Apr. 9, 2020

(87) PCT Pub. No.: WO2019/075088
PCT Pub. Date: Apr. 18, 2019

(65) Prior Publication Data

US 2021/0190386 A1 Jun. 24, 2021

Related U.S. Application Data

(60) Provisional application No. 62/570,517, filed on Oct. 10, 2017.

(51) Int. Cl.

| | |
|---|---|
| ***F25B 49/02*** | (2006.01) |
| ***F25B 1/04*** | (2006.01) |
| ***F25B 31/00*** | (2006.01) |

(52) U.S. Cl.
CPC ..... *F25B 1/04* (2013.01); *F25B 31/002* (2013.01); *F25B 31/006* (2013.01);
(Continued)

(58) Field of Classification Search
CPC .. H02P 29/60; F04B 53/08; F25B 1/04; F25B 31/002; F25B 31/006; F25B 49/022; F25B 49/025; F25B 2600/0253; F25B 2600/13
See application file for complete search history.

(56) References Cited

U.S. PATENT DOCUMENTS 7,003,971 B2 2/2006 Kester et al.
7,439,702 B2 10/2008 Smith et al.
(Continued)

FOREIGN PATENT DOCUMENTS

CN 101299571 A 11/2008
CN 102997345 A 3/2013
(Continued)

OTHER PUBLICATIONS

International Search Report and Written Opinion for PCT Application No. PCT/US2018/055251, dated Feb. 18, 2019, 16 pgs.
(Continued)

*Primary Examiner* — Jonathan Bradford
(74) *Attorney, Agent, or Firm* — Fletcher Yoder, P.C.

(57) ABSTRACT

In an embodiment of the present disclosure, a heating, ventilation, air conditioning, and refrigeration (HVAC&R) system includes a variable speed drive (VSD) enclosure. The VSD enclosure includes a main drive line variable speed drive (VSD) configured to supply power to a motor, and an oil pump variable speed drive (VSD) configured to supply power to a pump. The pump is configured to supply oil to one or more moving parts of the HVAC&R system. Additionally or in the alternative to the oil pump VSD, the VSD
(Continued)

enclosure includes a magnetic bearing controller and/or a magnetic bearing controller power supply. The magnetic bearing controller is configured to control magnetic bearings of the HVAC&R system.

21 Claims, 6 Drawing Sheets

(52) U.S. Cl.
CPC ..... *F25B 49/022* (2013.01); *F25B 49/025* (2013.01); *F25B 2600/0253* (2013.01); *F25B 2600/13* (2013.01)

(56) References Cited

U.S. PATENT DOCUMENTS

| | | | | |
|---|---|---|---|---|
| 9,429,151 | B2 | 8/2016 | Taras et al. | |
| 2004/0258542 | A1 | 12/2004 | Wiertz et al. | |
| 2007/0151272 | A1 | 7/2007 | Cosan et al. | |
| 2008/0115527 | A1* | 5/2008 | Doty | H02K 11/25 62/498 |
| 2008/0148746 | A1* | 6/2008 | Yanik | F25B 39/00 62/115 |
| 2008/0314998 | A1* | 12/2008 | Herzon | F25B 49/02 236/1 C |
| 2009/0229288 | A1* | 9/2009 | Alston | F25B 27/00 62/236 |
| 2012/0240614 | A1 | 9/2012 | Norbeck et al. | |
| 2013/0235494 | A1 | 9/2013 | Holce et al. | |
| 2015/0219378 | A1 | 8/2015 | Crane et al. | |
| 2015/0330659 | A1 | 11/2015 | West et al. | |
| 2016/0134214 | A1* | 5/2016 | Nakao | H02P 6/18 318/400.32 |
| 2016/0209097 | A1 | 7/2016 | Choueifati et al. | |
| 2018/0062556 | A1* | 3/2018 | Yue | B62D 5/0463 |
| 2018/0160571 | A1* | 6/2018 | Baker | H05K 7/20945 |

FOREIGN PATENT DOCUMENTS

| | | | |
|---|---|---|---|
| CN | 103261701 | A | 8/2013 |
| CN | 103312125 | A | 9/2013 |
| CN | 106152580 | A | 11/2016 |
| JP | 2007332974 | A | 12/2007 |
| JP | 2009150304 | A | 7/2009 |
| JP | 2017125647 | A | 7/2017 |
| KR | 20120061816 | A | 6/2012 |
| KR | 20120098860 | A | 9/2012 |
| WO | 2016040408 | A1 | 3/2016 |

OTHER PUBLICATIONS

Chinese Office Action for CN Application No. 201880062302.8, dated Mar. 3, 2021, 10 pgs.
Japanese Office Action for JP Application No. 2020-520496, dated Mar. 3, 2021, 4 pgs.
Korean Office Action for KR Application No. 10-2020-7013085, dated Apr. 19, 2021, 6 pgs.
Korean Office Action for KR Application No. 10-2020-7013085, dated Oct. 25, 2021, 2 pgs.
Japanese Office Action for JP Application No. 2020-520496, dated Oct. 28, 2021, 3 pgs.

* cited by examiner

SYSTEMS FOR A CHILLER ELECTRICAL ENCLOSURE

CROSS-REFERENCE TO RELATED APPLICATIONS

This application is a U.S. National Stage Application of PCT International Application No. PCT/US2018/055251, entitled "SYSTEMS FOR A CHILLER ELECTRICAL ENCLOSURE," filed Oct. 10, 2018, which claims priority from and the benefit of U.S. Provisional Application Ser. No. 62/570,517, entitled "SYSTEMS FOR A CHILLER ELECTRICAL ENCLOSURE," filed Oct. 10, 2017, which are hereby incorporated by reference in their entireties for all purposes.

BACKGROUND

This application relates generally to heating, ventilation, air conditioning, and refrigeration systems, and, more particularly, to an electrical enclosure for components of a chiller system.

Chiller systems, or vapor compression systems, utilize a working fluid, typically referred to as a refrigerant that changes phases between vapor, liquid, and combinations thereof in response to being subjected to different temperatures and pressures associated with operation of the vapor compression system. In some chiller systems, multiple enclosures may be provided for multiple respective components (e.g., power sources, control systems, variable speed drives, etc.). In such chiller systems, the multiple enclosures may utilize separate cooling systems and complex wiring/couplings to properly serve their function within the chiller system. Indeed, the chiller systems may have an enlarged footprint to accommodate the multiple enclosures.

SUMMARY

In an embodiment of the present disclosure, a heating, ventilation, air conditioning, and refrigeration (HVAC&R) system includes a refrigerant loop and a compressor disposed along the refrigerant loop. The compressor is configured to circulate refrigerant through the refrigerant loop. The HVAC&R system also includes a control panel and a variable speed drive (VSD) enclosure communicatively coupled to the control panel. The VSD enclosure includes a main drive line variable speed drive (VSD) configured to receive input from the control panel and to supply power to a motor of the compressor, and an oil pump variable speed drive (VSD) configured to supply power to an oil pump. The oil pump is configured to supply lubricant to the compressor.

In another embodiment of the present disclosure, a heating, ventilation, air conditioning, and refrigeration (HVAC&R) system includes a refrigerant loop and a compressor disposed along the refrigerant loop. The compressor is configured to circulate refrigerant through the refrigerant loop. The HVAC&R system also includes a control panel and a variable speed drive (VSD) enclosure communicatively coupled to the control panel. The VSD enclosure includes a main drive line variable speed drive (VSD) configured to receive input from the control panel and to supply power to a motor of the compressor, and a magnetic bearing controller configured to control magnetic bearings of the compressor.

In another embodiment of the present disclosure, a heating, ventilation, air conditioning, and refrigeration (HVAC&R) system includes a variable speed drive (VSD) enclosure. The VSD enclosure includes a main drive line variable speed drive (VSD) configured to supply power to a motor and an oil pump variable speed drive (VSD) configured to supply power to a pump. The pump is configured to supply oil to one or more moving parts of the HVAC&R system. The VSD enclosure also includes a magnetic bearing controller configured to control magnetic bearings of the HVAC&R system.

DETAILED DESCRIPTION

Embodiments of the present disclosure include a system that may reduce production and performance costs of a heating, ventilation, air conditioning, and refrigeration (HVAC&R) system. In certain HVAC&R systems, a chiller shell, or housing, may include multiple electrical enclosures for multiple sub-systems, or components, of the HVAC&R system. Particularly, an HVAC&R system may include an electrical enclosure for a chiller control panel, an electrical enclosure for a main drive line variable speed drive (VSD) panel, an electrical enclosure for an oil pump VSD, an electrical enclosure for a magnetic bearing controller (MBC) and/or an MBC power supply panel, and other enclosures. In some instances, each of the electrical enclosures for the sub-systems may require separate cooling systems. Further, the plethora of electrical enclosures for the different sub-systems may be mounted to a shell of the chiller, thereby requiring a large footprint of the chiller shell for mounting purposes. The separate cooling systems and power sources of the sub-systems may also draw an excessive amount of power to operate. Accordingly, the presently-disclosed embodiments may utilize a single electrical enclosure to house several sub-systems, such as electrical panels, with a unified cooling system. Indeed, the presently-disclosed embodiments may reduce a footprint of the sub-system electrical enclosures, reduce power drawn to cool the electrical enclosures, and reduce production and operation costs of the HVAC&R system.

Figure 1:
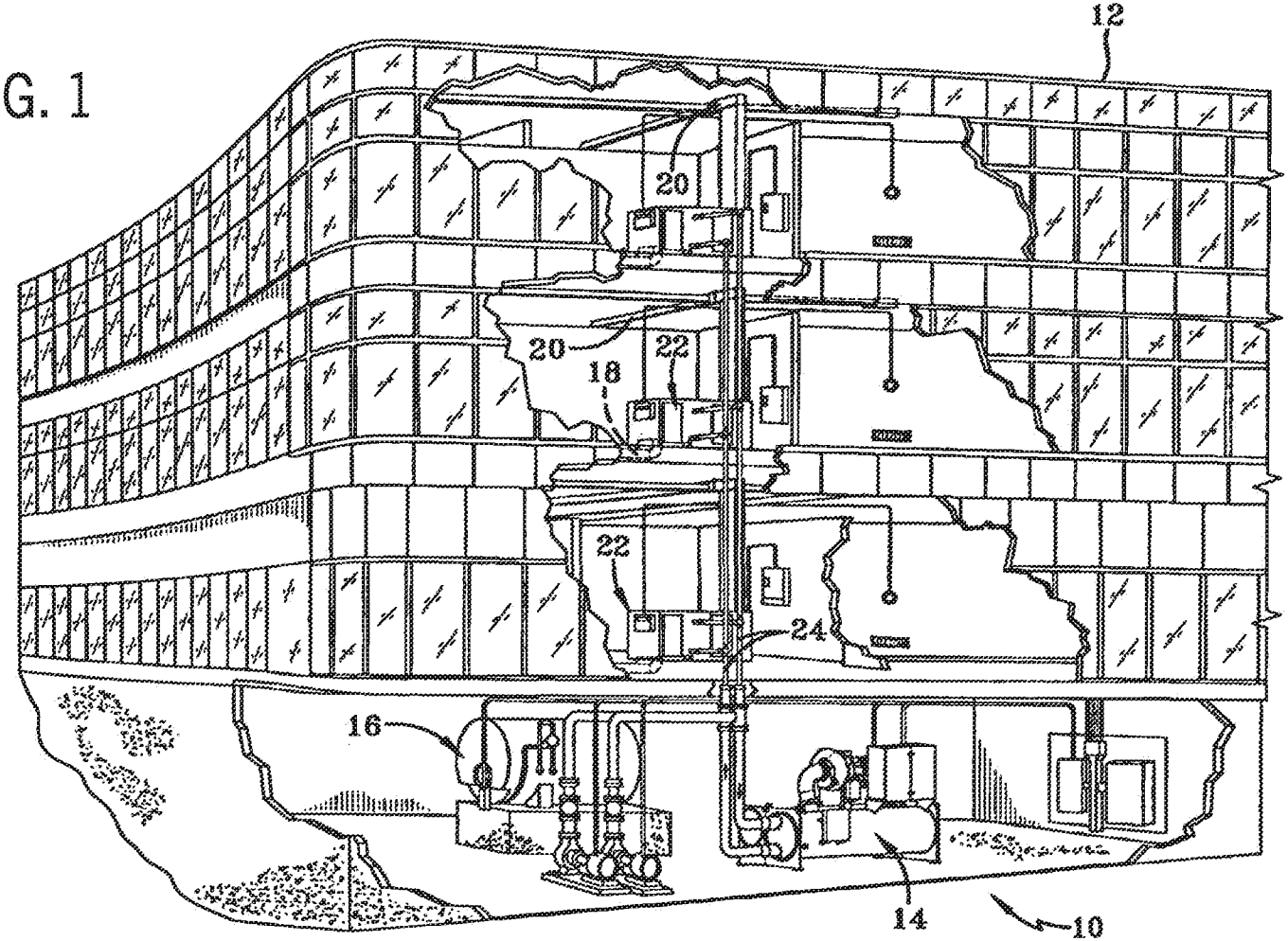
FIG. 1 is a perspective view of an embodiment of a building that may utilize a heating, ventilation, air conditioning, and refrigeration (HVAC&R) system in a commercial setting, in accordance with an aspect of the present disclosure.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
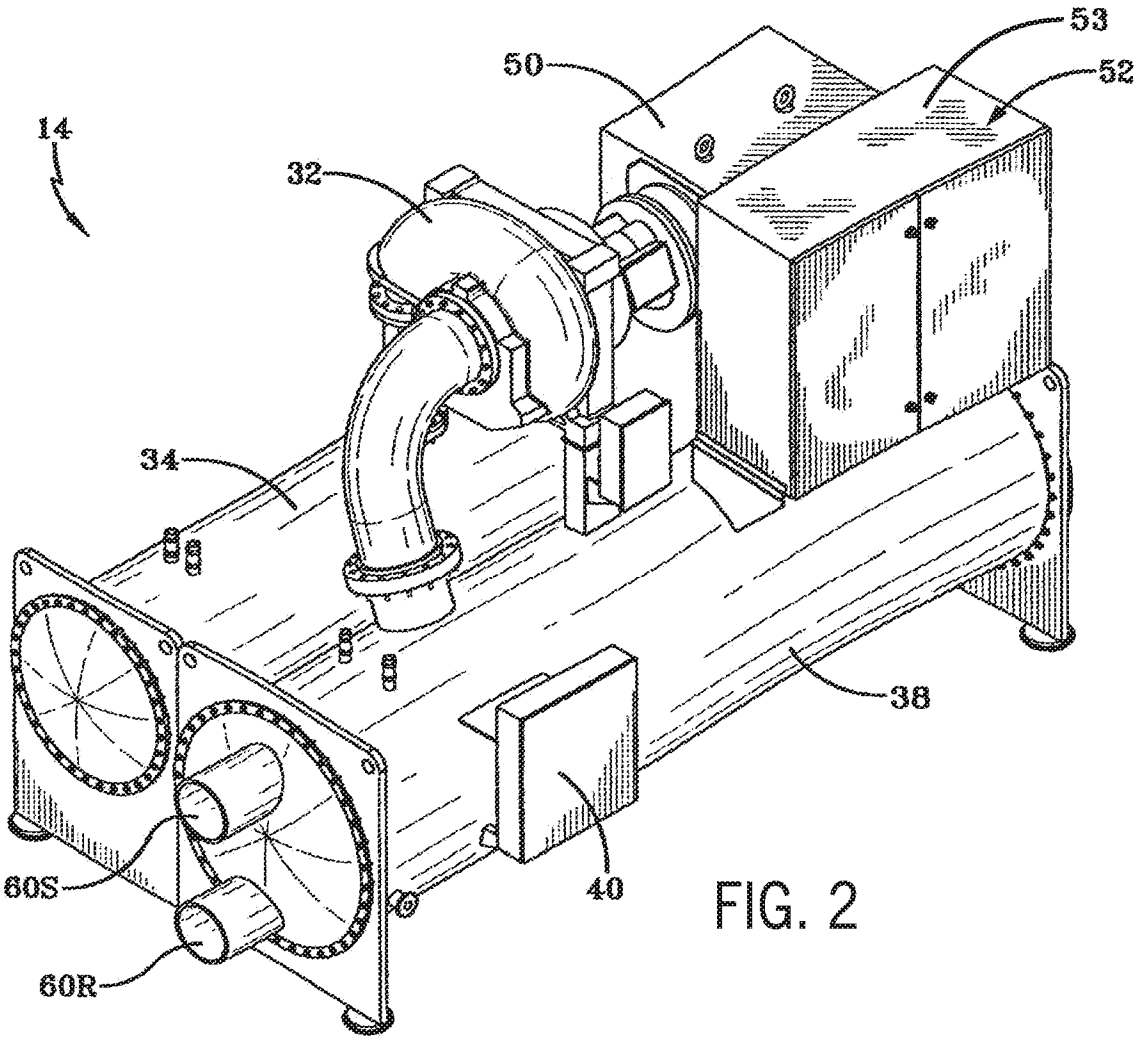
FIG. 2 is a perspective view of an embodiment of an HVAC&R system, in accordance with an aspect of the present disclosure.
Figure 3:
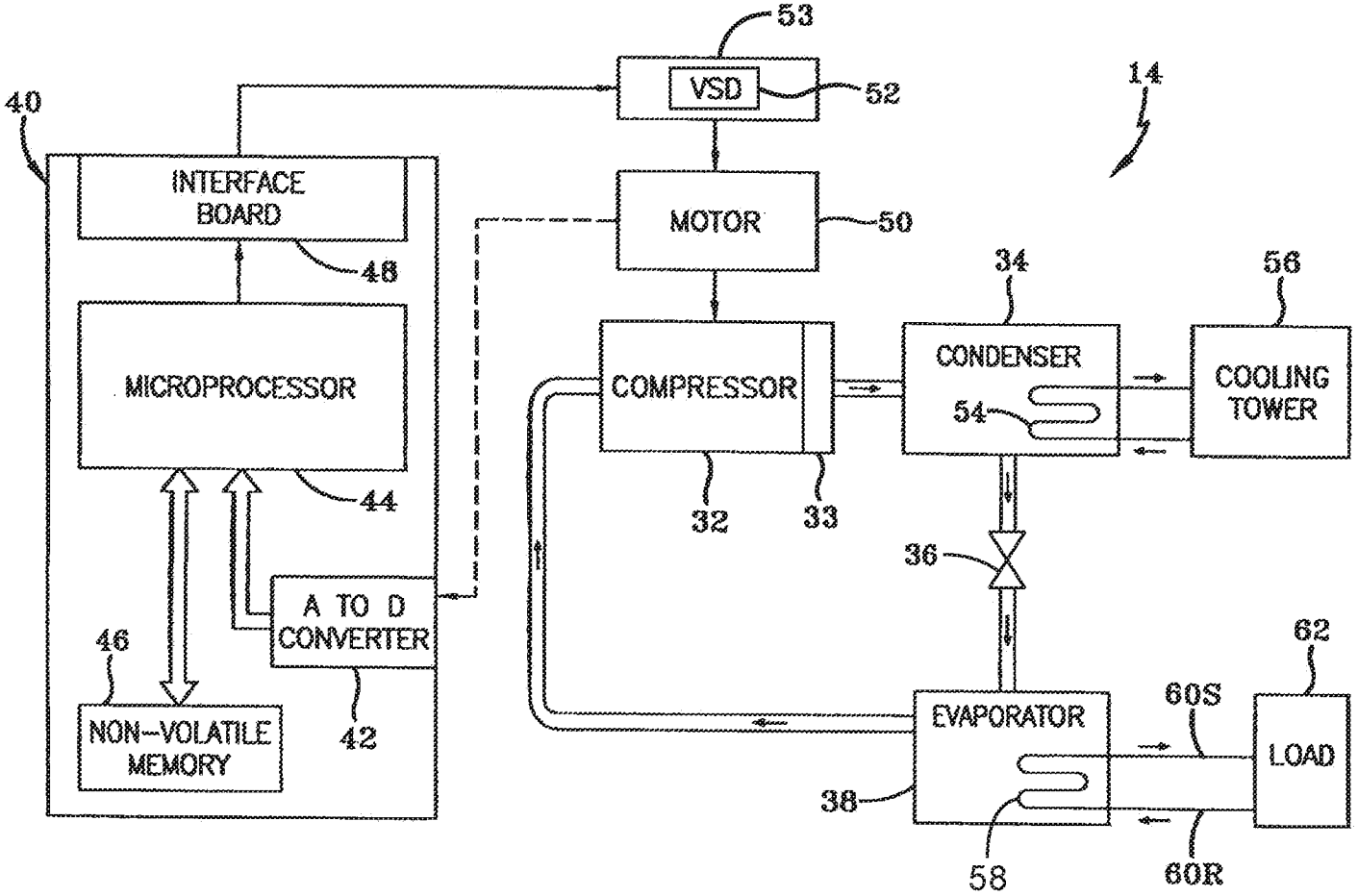
FIG. 3 is a schematic of an embodiment of the HVAC&R system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a main drive line variable speed drive (VSD) 52. The main drive line VSD 52 receives alternating current (AC) power having a particular fixed line voltage and fixed line frequency from an AC power source, and provides power having a variable voltage and frequency to the motor 50. In some embodiments, the main drive line VSD 52 may be housed within a VSD enclosure 53 (e.g., an electrical enclosure). As discussed below, the VSD enclosure 53 may house a variety of components. In some embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. Further, in some embodiments, the discharge passage may include diffuser, such as variable geometry diffuser 33. The variable geometry diffuser 33 may modify its shape to adjust a fluid flow rate through the compressor 32. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

As discussed in detail below, the VSD enclosure 53 may include a variety of electrical components, or panels, configured to perform a variety of functions of the vapor compression system 14. For example, the VSD enclosure 53 may include a cooling system, which may regulate a temperature within the VSD enclosure 53. Indeed, power sources, controllers, and the like within the VSD enclosure 53 may require a suitable temperature to operate efficiently and perform their intended functions.

Figure 4:
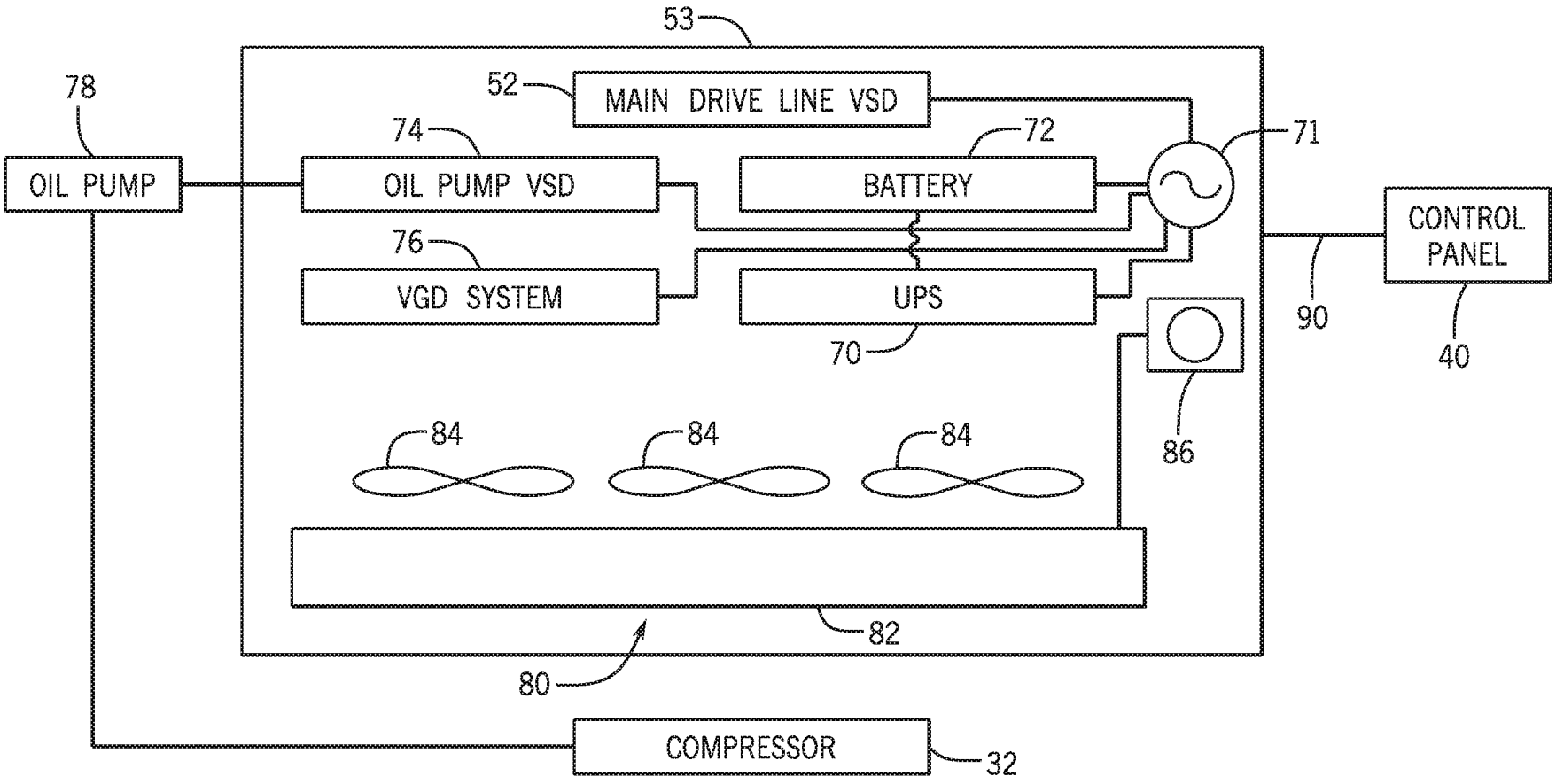
FIG. 4 is a block diagram of a main drive line variable speed drive (VSD) enclosure of the HVAC&R system of FIG. 2, in accordance with an embodiment of the present disclosure.

Keeping this in mind, FIG. 4 is a schematic view of the VSD enclosure 53, including various components of the vapor compression system 14. For example, in the illustrated embodiment, the VSD enclosure 53 includes the main drive line VSD 52, an uninterruptible power supply (UPS) 70, a power supply 71, a battery 72, an oil pump VSD 74, and a variable geometry diffuser (VGD) system 76, which may include a VGD controller and/or a VGD power supply. Indeed, the VGD power supply may be configured to supply power to the VGD 33 (FIG. 3) and/or the VGD controller, which in some embodiments, may also be disposed within the VSD enclosure 53. In some embodiments, each of the main drive line VSD 52, the UPS 70, the battery 72, the power supply 71, the oil pump VSD 74, and the VGD system 76 may be associated with, or coupled to, different electrical panels, or circuit boards. In the current embodiment, within the VSD enclosure 53, the oil pump VSD 74 may be associated with a first electrical panel, the UPS 70 and the VGD system 76 may be associated with a second electrical panel, and the main drive line VSD 52 may be associated with a third electrical panel. In such embodiments, the battery 72 may be coupled to the first electrical panel, the second electrical panel, the third electrical panel, or any combination thereof, and the power supply 71 may be coupled to the first electrical panel, the second electrical panel, the third electrical panel, or any combination thereof.

The oil pump VSD 74 may receive alternating current (AC) power having a particular fixed line voltage and fixed line frequency from an AC power source, and may provide power having a variable voltage and frequency to an oil pump 78. In turn, the oil pump 78 may provide a lubricant, such as oil, to bearings and/or other moving parts of the compressor 32. Further, the oil pump 78 may be any suitable pump such as a twin gear pump, a rotor pump, or a front cover oil pump.

The VGD system 76, and more specifically, the VGD controller of the VGD system 76, may monitor the position of a variable geometry diffuser of the compressor 32 via one or more sensors and may actuate the diffuser between a fully open and a fully closed position in response to operating conditions of the compressor 32. For example, in some embodiments, the compressor 32 may operate by passing fluid over one or more compression mechanism such as pistons, rotors, scrolls, lobes, impellers and the like, depending on the type of compressor 32. The compression mechanism works on the fluid to increase a pressure of the fluid. However, the operation of the compression mechanism may create an adverse pressure gradient in the fluid flow. Indeed, regardless of the type of compression system of the compressor 32, the VGD system 76 may actuate the VGD 33 to stabilize fluid flow of the compressor 32.

The battery 72 may be any suitable battery capable of supplying power to the oil pump VSD 74, the main drive line VSD 52, the VGD system 76, the control panel 40, or any combination thereof. Indeed, the battery 72 may be a primary battery type, a secondary battery type, or any other suitable battery type.

In some embodiments, the power supply 71 may utilize any suitable power source such as a power grid, a battery, a solar panel, an electrical generator, a gas engine, the vapor compression system 14, or any combination thereof. Particularly, the power supply 71 may supply power to the main drive line VSD 52, the oil pump VSD 74, the VGD system 76, or any combination thereof. Additionally, or in the alternative, the power supply 71 may provide power to, or charge, the battery 72 and/or the UPS 70.

The UPS 70 is an electric apparatus which may provide back-up power to a load when a main power source to the load discontinues a supply of power. Particularly, the UPS 70 may provide power to the load substantially instantaneously when the main power source discontinues the supply of power. In some embodiments, the UPS 70 may utilize, or supply, power that is stored in batteries, supercapacitors, flywheels, or any combination thereof. In some embodiments, the UPS 70 may supply power to the oil pump VSD 74 and/or the VGD system 76 if the power supply 73 and/or the battery 72 discontinues a supply of power to the oil pump VSD 74 and/or the VGD system 76.

Further, in some embodiments, the VSD enclosure 53, and more specifically, components within the VSD enclosure 53, may be communicatively coupled to the control panel 40. For example, in some embodiments, the control panel 40 may provide instructions via the interface board 48 and/or the microprocessor 44 to the main drive line VSD 52, the VGD system 76, and/or the oil pump VSD 74 to operate in an intended manner. Indeed, in some embodiments, the instructions provided from the control panel 40 may be based on operator input (e.g., via the interface board 48) and/or may be based on data collected from one or more sensors of the vapor compression system 14.

As mentioned above, components (e.g., the main drive line VSD 52, the UPS 70, the battery 72, the power supply 70, the oil pump VSD 74, and/or the VGD system 76) of the VSD enclosure 53 may release heat, or thermal energy, within the VSD enclosure 53. Accordingly, the VSD enclosure 53 may include a cooling system 80 to regulate an internal temperature of the VSD enclosure 53. The cooling system 80 may include a heat exchanger 82, which may be an air to water heat exchanger and utilize a liquid cooling system. For example, in some embodiments, the heat exchanger 82 may receive water from the condenser 34. Particularly, the heat exchanger 82 may receive water from an outlet of the condenser 34 and/or from an intermediate stage within the condenser 34. Additionally, or in the alternative, the heat exchanger 82 may receive water from the evaporator 38. Particularly, the heat exchanger 82 may receive water from an outlet of the evaporator 38 and/or from an intermediate state within the evaporator 38.

The water received from the condenser 34 and/or the evaporator 38 may be routed through tubing (e.g., piping, coils, etc.) of the heat exchanger 82. Further, the cooling system 80 may also include one or more fans 84, which may push or pull air (e.g., internal air, ambient air, surrounding air, etc.) over the tubing. In some embodiments, the one or more fans 84 may pull air from a source external to the VSD enclosure 53, such as through a vent. Additionally, or in the alternative, the one or more fans 84 may circulate and recycle, or re-condition, air within the VSD enclosure 53. Further, in some embodiments, the battery 72 and/or the power supply 71 may be utilized to power the one or more fans 84.

Further, the water received by the heat exchanger 82 from the condenser 34 and/or the evaporator 38 may be chilled water (e.g., water at a suitably low temperature). In this manner, the air that the one or more fans 84 pushes or pulls over the tubes may exchange heat with the water flowing through the tubes to increase a temperature of the water and decrease a temperature of the air. Particularly, the heat exchanger 82 may remove heat and/or moisture from the air that is being pushed or pulled over the tubes to produce conditioned air. That is, the cooling system 80 may condition the air such that the air that is supplied from the cooling system 80 to the components (e.g., the main drive line VSD 52, the UPS 70, the battery 72, the power supply 70, the oil pump VSD 74, and the VGD system 76) within the VSD enclosure 53 may be at a suitably low temperature, as discussed in further detail below.

Once the water has traveled through the tubes of the heat exchanger 82 and has exchanged heat with the air that is pulled or pushed across the tubes, the water may be routed to a suitable location within the circuit of the vapor compression system 14. For example, after exchanging heat with the air, the water may undergo a phase change, such as from a liquid to a vapor, an increase in temperature, and/or an increase and/or decrease in pressure. Accordingly, when exiting the heat exchanger 80, the water may be routed to a section of the circuit of the vapor compression system 14 which contains water that substantially matches the pressure and temperature of the water exiting the heat exchanger 82.

In some embodiments, the cooling system 80 may also include a control device 86, one type of which may be a thermostat, which may be used to designate the temperature of the conditioned air output from the cooling system 80. Specifically, the control device 86 may be used to control the flow of air through the heat exchanger 82 by controlling a speed of the one or more fans 84. In some embodiments, other devices may be included in the cooling system 80, such as pressure and/or temperature transducers or switches that sense the temperatures and pressures of the supply air, return air, and so forth. Moreover, the control device 16 may include computer systems that are integrated with or separate from other control or monitoring systems, and even systems that are remote from the building 12. In some embodiments, the control device 86 may receive input regarding a set point temperature, such as from an operator. The control device 86 may also receive data indicative of a temperature within the VSD enclosure 53, such as from a temperature sensor. The control device 86 may analyze the data indicative of the temperature within the VSD enclosure 53 and compare the temperature within the VSD enclosure to the set point temperature. Based on the comparison, the control device 86 may then increase or decrease a speed of the one or more fans 84 to modify the internal temperature of the VSD enclosure 53 to substantially match the set point temperature. Additionally, some embodiments, the cooling system 80 may utilize a heat sink to help regulate the temperature of the VSD enclosure 53.

In some embodiments, the cooling system 80 may regulate the temperature of the VSD enclosure 53 such that the internal temperature of the VSD enclosure 53 remains below 50 degrees Celsius. In some embodiments, the cooling system 80 may regulate the temperature of the VSD enclosure 53 to ensure that the temperature remains below 40 degrees Celsius.

Further, in the current embodiment, the VSD enclosure 53 may be communicatively coupled to the control panel 40 via one or more wires 90 or other suitable medium to transfer signals and/or data. Indeed, one or more components (e.g., the main drive line VSD 52, the UPS 70, the battery 72, the power supply 71, the oil pump VSD 74, and/or the VGD system 76) of the VSD enclosure 53 may receive various inputs from the control panel 40. More specifically, an operator may provide various commands through the interface board 48 to control one or more of the components within the VSD enclosure 53.

Figure 5:
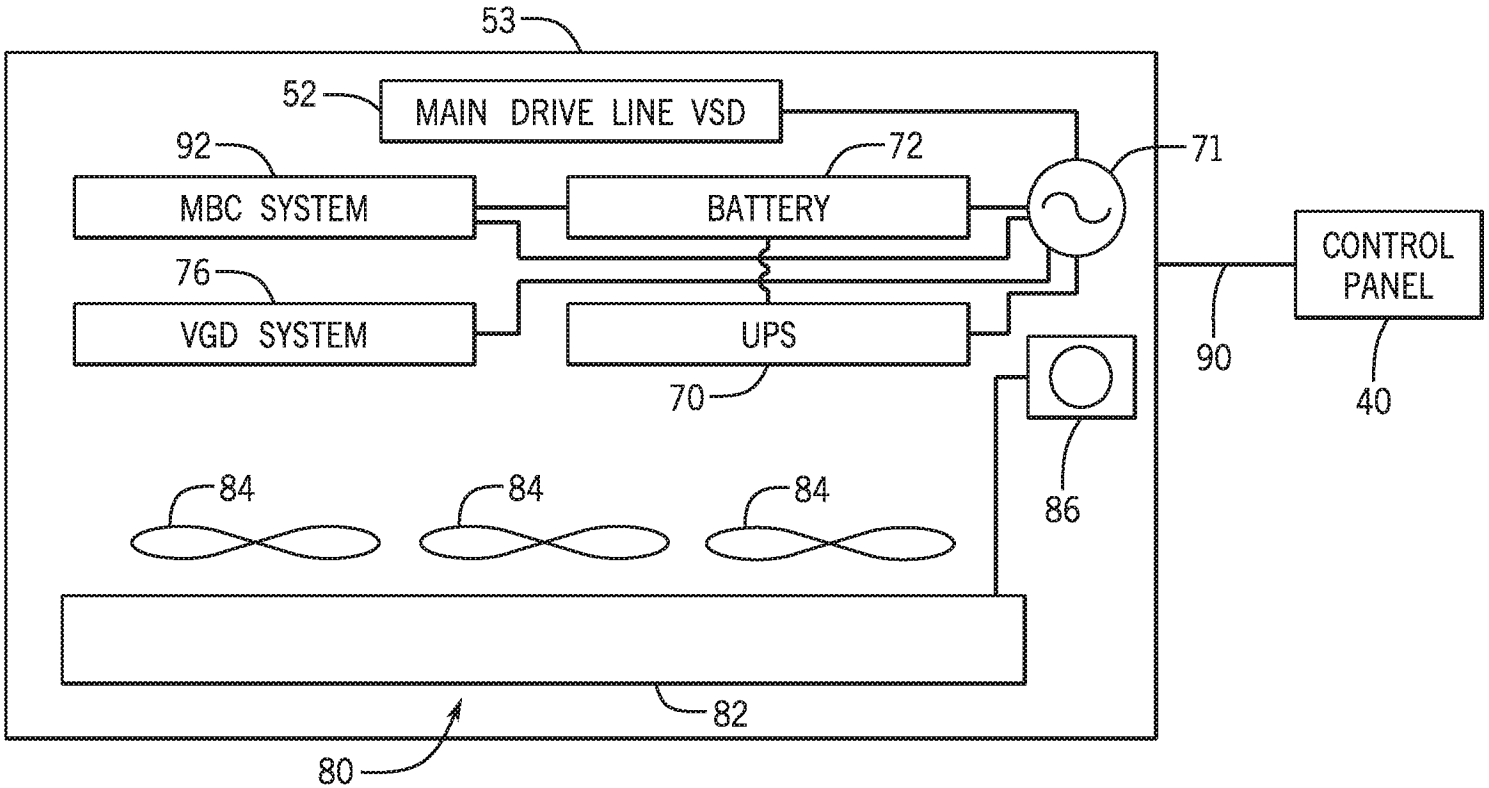
FIG. 5 is a block diagram of a main drive line variable speed drive (VSD) enclosure of the HVAC&R system of FIG. 2, in accordance with an embodiment of the present disclosure.

FIG. 5 is a schematic view of the VSD enclosure 53 including various components of the vapor compression system 14, in accordance with an embodiment of the present disclosure. In the illustrated embodiment, the VSD enclosure 53 includes the main drive line VSD 52, the uninterruptible power supply 70, the power supply 71, the battery 72, and the variable geometry diffuser (VGD) system 76. Further, the VSD enclosure 53 may include a magnetic bearing control (MBC) system 92, which may include a magnetic bearing controller and/or a magnetic bearing controller power supply. Indeed, the magnetic bearing controller power supply may be configured to supply power to the magnetic bearing controller, which in some embodiments, may also be disposed within the VSD enclosure 53.

For example, in some embodiments, the compressor 32 may utilize magnetic bearings to support one or more moving parts. Particularly, in some embodiments, the compressor 32 may utilize permanent magnets to carry a static load of the one or more moving parts and utilize active magnets when the one or more moving parts deviate from an optimum position. Accordingly, the MBC system 92, and more specifically, the MBC controller, may monitor the position of the one or more moving parts (e.g., a shaft) of the compressor 32 relative to the magnetic bearings of the compressor 32 and send one or more signals to control the active magnets such that the load substantially remains at the optimum position.

In some embodiments, the MBC system 92 may receive power from the battery 72, the UPS 70, the power supply 71, or any combination thereof. For example, in certain embodiments, the battery 72 and/or the power supply 71 may supply power to the MBC system 92 consistently, and the UPS 70 may supply power to the MBC system 92 as a back-up power source of power. Further, the cooling system 80 may function as described above to regulate the internal temperature of the VSD enclosure 53, and by extent, regulate the temperature of the components within the VSD enclosure 53, which includes the MBC system 92.

Further, in the illustrated embodiment, the VSD enclosure 53 is communicatively coupled to the control panel 40 via the one or more wires 90 or other suitable medium to transfer signals and/or data. Indeed, one or more components (e.g., the main drive line VSD 52, the UPS 70, the battery 72, the power supply 70, the MBC system 92, and/or the VGD system 76) of the VSD enclosure 53 may receive various inputs from the control panel 40. More specifically, an operator may provide various commands through the interface board 48 to control one or more of the components within the VSD enclosure 53.

Further, in some embodiments, within the VSD enclosure 53, the MBC system 92, the UPS 70, and the VGD system 76 may be associated with a first electrical panel, and the main drive line VSD 52 may be associated with a second electrical panel. In such embodiments, the battery 72 may be coupled to the first electrical panel, the second electrical panel, or both, and the power supply 71 may be coupled to the first electrical panel, the second electrical panel, or both.

Figure 6:
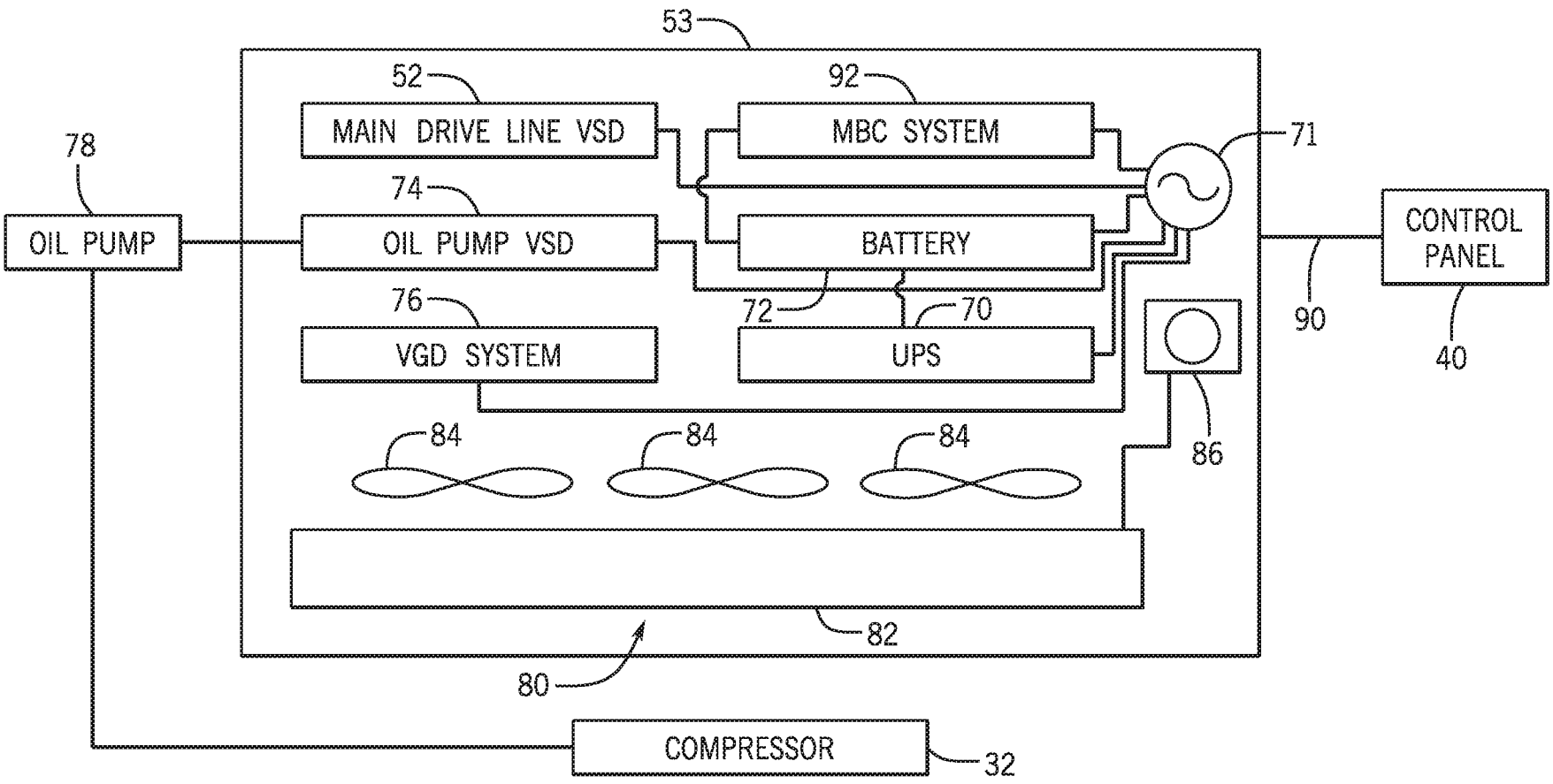
FIG. 6 is a block diagram of a main drive line variable speed drive (VSD) enclosure of the HVAC&R system of FIG. 2, in accordance with an embodiment of the present disclosure.

FIG. 6 is a block diagram of the VSD enclosure 53 including various components of the vapor compression system 14, in accordance with an embodiment of the present disclosure. In the illustrated embodiment, the VSD enclosure 53 includes the main drive line VSD 52, the UPS 70, the power supply 71, the battery 72, and the VGD system 76. Further, the VSD enclosure 53 may include the oil pump VSD 74 and the MBC system 92. As such, the VSD enclosure 53 may be applicable to a vapor compression system 14 that utilizes magnetic bearings and/or mechanical roller bearings.

The oil pump VSD 74 may function as described above with respect to FIG. 4, and the MBC system 92 may function as described above with respect to FIG. 5. For example, in some embodiments, the oil pump VSD 74 may supply power at a suitable voltage and frequency to the oil pump 78, which may in turn supply oil, or lubricant, to moving parts within the compressor 32. Further, the MBC system 92 may send one or more signals to control active magnet bearings of the compressor 32

In some embodiments, the MBC system 92 and/or the oil pump VSD 74 may receive power from the battery 72, the UPS 70, the power supply 71, or any combination thereof. For example, in certain embodiments, the battery 72 and/or the power supply 71 may supply power to the MBC system 92 and/or the oil pump VSD 74 consistently and the UPS 70 may supply power to the MBC system 92 and/or the oil pump VSD 74 as a back-up power source. Further, the cooling system 80 may function as described above to regulate the internal temperature of the VSD enclosure 53, and by extent, regulate the temperature of the components within the VSD enclosure 53, which includes the MBC system 92 and the oil pump VSD 74.

Further, in the current embodiment, the VSD enclosure 53 may be communicatively coupled to the control panel 40 via the one or more wires 90 or other suitable medium to transfer signals and/or data. Indeed, one or more components (e.g., the main drive line VSD 52, the UPS 70, the battery 72, the power supply 70, the MBC system 92, the oil pump VSD 74 and/or the VGD system 76) of the VSD enclosure 53 may receive various inputs from the control panel 40. More specifically, an operator may provide various commands through the interface board 48 to control one or more of the components within the VSD enclosure 53.

In the current embodiment, within the VSD enclosure 53, the main drive line VSD 52 may be associated with a first electrical panel, the oil pump VSD 74 may be associated with a second electrical panel, and the MBC system 92, the UPS 70, and the VGD system 76 may be associated with a third electrical panel. In such embodiments, the battery 72 may be coupled to the first electrical panel, the second electrical panel, the electrical third panel, or any combination thereof, and the power supply 73 may be coupled to the first electrical panel, the second electrical panel, the third electrical panel, or any combination thereof.

Accordingly, the present disclosure is directed to providing systems of a chiller system including a variable speed drive (VSD) enclosure (e.g., electrical enclosure) having a variety of components and/or panels. For example, the VSD enclosure may include an oil pump VSD, a magnetic bearing controller and/or a magnetic bearing controller power supply, a variable geometry diffuser controller and/or variable geometry diffuser power supply, a battery, a power supply, an uninterruptible power supply, or any combination thereof. Indeed, these components may be included on a variety of electrical panels within the VSD enclosure. Further, the VSD enclosure may utilize a unitary cooling system, such as an air to water heat exchanger, to regulate the temperature within the VSD enclosure. Indeed, each of the components within the VSD enclosure may be cooled by the unitary cooling system, thereby saving in cooling costs relative to systems utilizing multiple cooling systems for the multiple components. Further, due to the consolidation of the components to within the VSD enclosure, the footprint utilized by the components may be also be reduced. Still further, the components within the VSD enclosure may utilize common power sources, thereby saving in production and/or power costs.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning, and refrigeration (HVAC&R) system, comprising:

a refrigerant loop;

a compressor disposed along the refrigerant loop and configured to circulate refrigerant through the refrigerant loop;

a control panel;

a variable speed drive (VSD) enclosure housing a plurality of components, wherein the compressor is external to the VSD enclosure, and wherein the plurality of components comprises:

a main drive line VSD configured to receive an input from the control panel and to supply power to a motor of the compressor; and an oil pump VSD configured to supply power to an oil pump, wherein the oil pump is configured to supply lubricant to the compressor; and a cooling system comprising a heat exchanger configured to receive a chilled fluid from a refrigerant loop component fluidly coupled to the refrigerant loop, wherein the heat exchanger is external to the main drive line VSD and the oil pump VSD and is configured to condition an interior of the VSD enclosure.

2. The HVAC&R system of claim 1, wherein the VSD enclosure houses a variable geometry diffuser controller and/or a variable geometry diffuser power supply communicatively coupled to a variable geometry diffuser of the compressor.

3. The HVAC&R system of claim 1, wherein the VSD enclosure houses an uninterruptible power supply configured to supply power to one or more of the plurality of components positioned within the VSD enclosure.

4. The HVAC&R system of claim 1, wherein the VSD enclosure houses a battery and a power supply, wherein the battery and the power supply are each configured to supply power to one or more of the plurality of components positioned within the VSD enclosure.

5. The HVAC&R system of claim 1, wherein the cooling system comprises one or more fans configured to push and/or pull air across one or more tubes of the heat exchanger to facilitate supply of conditioned air to the interior of the VSD enclosure.

6. The HVAC&R system of claim 1, wherein the chilled fluid comprises water, wherein the cooling system is configured to increase a temperature of the water and route the water to an evaporator fluidly coupled to the refrigerant loop.

7. The HVAC&R system of claim 1, wherein the VSD enclosure houses a magnetic bearing controller configured to control magnetic bearings of the compressor.

8. The HVAC&R system of claim 1, wherein the cooling system comprises one or more fans configured to draw air across one or more tubes of the heat exchanger to generate a conditioned air flow to regulate a temperature of the interior of the VSD enclosure, wherein the chilled fluid comprises chilled water.

9. The HVAC&R system of claim 8, comprising a controller disposed within the interior of the VSD enclosure and configured to receive feedback from a sensor indicative of the temperature within the interior, wherein the controller is configured to adjust a speed of the one or more fans based on the feedback to adjust the temperature of the interior.

10. The HVAC&R system of claim 9, wherein the controller is configured to receive an additional input indicative of a set point temperature for the interior of the VSD enclosure, wherein the controller is configured to adjust the speed of the one or more fans based on the feedback to adjust the temperature of the interior to approach the set point temperature.

11. The HVAC&R system of claim 1, wherein the heat exchanger is disposed within the interior of the VSD enclosure, wherein the refrigerant loop component of the refrigerant loop is configured to receive a flow of the refrigerant from the compressor of the refrigerant loop, and wherein the chilled fluid comprises chilled water.

12. The HVAC&R system of claim 11, wherein the refrigerant loop component comprises an evaporator or a condenser of the refrigerant loop.

13. The HVAC&R system of claim 1, wherein the heat exchanger is disposed separate from the main drive line VSD and the oil pump VSD, and wherein the cooling system comprises one or more fans configured to draw air across the heat exchanger to generate a conditioned air flow to condition the interior of the VSD enclosure to cool each of the plurality of components.

14. A heating, ventilation, air conditioning, and refrigeration (HVAC&R) system, comprising:

a refrigerant loop;

a compressor disposed along the refrigerant loop and configured to circulate refrigerant through the refrigerant loop;

a control panel;

a variable speed drive (VSD) enclosure housing a plurality of components, wherein the compressor is external to the VSD enclosure, and wherein the plurality of components comprises:

a main drive line VSD configured to receive an input from the control panel and to supply power to a motor of the compressor; and a magnetic bearing controller and/or a magnetic bearing controller power supply, wherein the magnetic bearing controller is configured to control magnetic bearings of the compressor; and a cooling system comprising a heat exchanger disposed in an interior of the VSD enclosure and external to the main drive line VSD, wherein the heat exchanger is configured to receive a chilled fluid from a refrigerant loop component fluidly coupled to the refrigerant loop to condition the interior of the VSD enclosure.

15. The HVAC&R system of claim 14, wherein the VSD enclosure houses a variable geometry diffuser controller and/or a variable geometry diffuser power supply communicatively coupled to a variable geometry diffuser of the compressor.

16. The HVAC&R system of claim 14, wherein the VSD enclosure houses an uninterruptible power supply configured to supply power to one or more of the plurality of components disposed within the VSD enclosure.

17. The HVAC&R system of claim 14, wherein the heat exchanger comprises an air to water heat exchanger fluidly coupled to a condenser or an evaporator of the refrigerant loop, and wherein the cooling system comprises one or more fans configured to draw air across the air to water heat exchanger to facilitate supply of conditioned air to one or more of the plurality of components positioned within the VSD enclosure.

18. The HVAC&R system of claim 14, wherein the VSD enclosure comprises an oil pump variable VSD configured to supply power to an oil pump, wherein the oil pump is configured to supply lubricant to the compressor.

19. A heating, ventilation, air conditioning, and refrigeration (HVAC&R) system, comprising:

a variable speed drive (VSD) enclosure, wherein the VSD enclosure houses a plurality of components, and wherein the plurality of components comprises:

a main drive line VSD configured to supply power to a motor of a compressor;

an oil pump VSD configured to supply power to a pump, wherein the pump is configured to supply oil to one or more moving parts of the HVAC&R system; and a magnetic bearing controller and/or a magnetic bearing controller power supply, wherein the magnetic bearing controller is configured to control magnetic bearings of the HVAC&R system; and a cooling system comprising a heat exchanger positioned separate from the main drive line VSD and the oil pump VSD, wherein the heat exchanger is configured to condition an interior of the VSD enclosure via a chilled fluid received from a refrigerant loop component fluidly coupled to the compressor and based on a set point temperature for the interior.

20. The HVAC&R system of claim 19, wherein the heat exchanger comprises an air to water heat exchanger configured to receive the chilled fluid water from a condenser or an evaporator fluidly coupled to the compressor, and wherein the cooling system comprises one or more fans configured to draw an air flow across the air to water heat exchanger to generate a conditioned air flow, wherein the one or more fans are configured to direct the conditioned air flow through the interior of the VSD enclosure to adjust a temperature within the VSD enclosure toward the set point temperature.

21. The HVAC&R system of claim 19, wherein the VSD enclosure houses a variable geometry diffuser controller and/or a variable geometry diffuser power supply communicatively coupled to a variable geometry diffuser of the compressor.

* * * * *